US006931868B1

(12) United States Patent
Goldstein

(10) Patent No.: US 6,931,868 B1
(45) Date of Patent: Aug. 23, 2005

(54) AIR CONDITIONING SYSTEM

(76) Inventor: Stanley Goldstein, 2533 W. Avenue O, Palmdale, CA (US) 93551

( * ) Notice: Subject to any disclaimer, the term of this patent is extended or adjusted under 35 U.S.C. 154(b) by 0 days.

(21) Appl. No.: 10/666,394

(22) Filed: Sep. 18, 2003

Related U.S. Application Data

(63) Continuation-in-part of application No. 09/945,403, filed on Feb. 6, 2002, now abandoned.

(60) Provisional application No. 60/230,177, filed on Sep. 1, 2000.

(51) Int. Cl.[7] ..... F25B 29/00
(52) U.S. Cl. ..... 62/173
(58) Field of Search ..... 62/173, 176.5, 62/90

(56) References Cited

U.S. PATENT DOCUMENTS 4,770,001 A * 9/1988 Kittler ..... 62/238.6
5,493,871 A * 2/1996 Eiermann ..... 62/173
6,123,147 A * 9/2000 Pittman ..... 165/228

* cited by examiner

*Primary Examiner*—Melvin Jones
(74) *Attorney, Agent, or Firm*—Dennis W. Beech

(57) ABSTRACT

The air conditioning system for conditioning of an airflow stream uses a fluid flow system to control operational modes of heating, cooling, dehumidifying freeze protection and defrost. The fluid flow system allows an air conditioning system to operate using a hot fluid source without the need for a gas or oil direct heat air stream heat system. The fluid flow system circulates fluid through a reheat coil and a precooling coil or a bypass conduit thereof depending on the operating mode of the system. Routing of fluid flow is controlled by a hot water control valve and a bypass valve under control of a control panel and a check valve stabilizing the fluid pressure minimizing formation of gas bubbles in the fluid which condition may degrade system performance.

26 Claims, 8 Drawing Sheets

AIR CONDITIONING SYSTEM

This application is a continuation-in-part of application Ser. No. 09/945,403 filed Feb. 6, 2002 which application claims the benefit of U.S. Provisional Application Ser. No. 60/230,177 filed Sep. 1, 2000. Application Ser. No. 09/945,403 is now abandoned.

BACKGROUND OF THE INVENTION

This invention relates to air conditioning systems that include the feature of heating, cooling, humidifying and dehumidifying an air flow stream, using a hot fluid source when heating, in a fluid loop circulating configuration. The improved air conditioning system uses a hot water control valve and a bypass valve in combination with a check valve in a fluid communicative system including reheat, cooling and precooling coils to condition an air flow stream.

Conventional and known air conditioning systems have been designed to attempt to work without the need for direct heat oil or gas burning systems. However, these systems tend to be inefficient and subject to failure. An example of elements that would be used in such existing systems is disclosed in U.S. Pat. No. 5,802,862. While this invention addresses various elements to be used in a system, it does not solve or anticipate the solution to the problem of inefficient operation of air conditioning systems due to improper fan control, fluid loop pressure imbalances during operation and the formation of gas bubbles when domestic water is used as the fluid source for a water loop system.

The present invention has a circulating fluid system that may use a water loop system for use with a hot water heating system that is moderated by a check valve with a lower system air pressure drop than a system with separate heating and cooling circuits such as a heat pipe system. No combustion air is required such as with a furnace or electric heat elements in the air duct system as with an air-to-air heat pump. The hot water supply may be kept at approximately 135 degrees to minimize formation of bacteria in the domestic hot water supply system. The system may also be operated in a whole house dehumidification mode with minimal energy consumption. By control setting of the operational sequencing of fluid flow, and air flow fan speed the latent capacity of the system is enhanced and the air conditioning system may perform properly while in low speed fan and fluid flow to save energy consumption. A further feature allows operation of the system to deliver low space humidity levels in a building.

As can be seen, there is a need for a multioperational mode air conditioning system that may use domestic hot water as a heat source and that operates efficiently to condition an air stream flow.

SUMMARY OF THE INVENTION

An improved air conditioning system according to the present invention comprises a fluid flow system, a control panel for operation thereof and a check valve in communication with a hot water source.

In an aspect of the present invention the fluid flow system comprises a reheat coil downstream of a cooling coil and a precool coil wherein the reheat coil and precool coil are in fluid communication one with the other. A recirculating pump circulates water from a hot water control valve through the reheat coil to a bypass valve. The bypass valve is set to route the water through the precool coil or through a bypass conduit for return to the hot water control valve or to exit through a check valve. The check valve is structured to minimize the formation of gas bubbles in the water which condition degrades the performance of the air conditioning system. The hot water control valve may be set to recirculate the water or to receive hot water from a hot water source. A control panel functions to set the position of the bypass valve and hot water control valve, and to set the sequence of turn on and turn off of the recirculating pump as well as operation of the fan and other air conditioning system elements.

These and other features, aspects and advantages of the present invention will become better understood with reference to the following drawings, description and claims.

DESCRIPTION OF THE PREFERRED EMBODIMENT

The following detailed description is the best currently contemplated modes for carrying out the invention. The description is not to be taken in a limiting sense, but is made merely for the purpose of illustrating the general principles of the invention.

Figure 1:
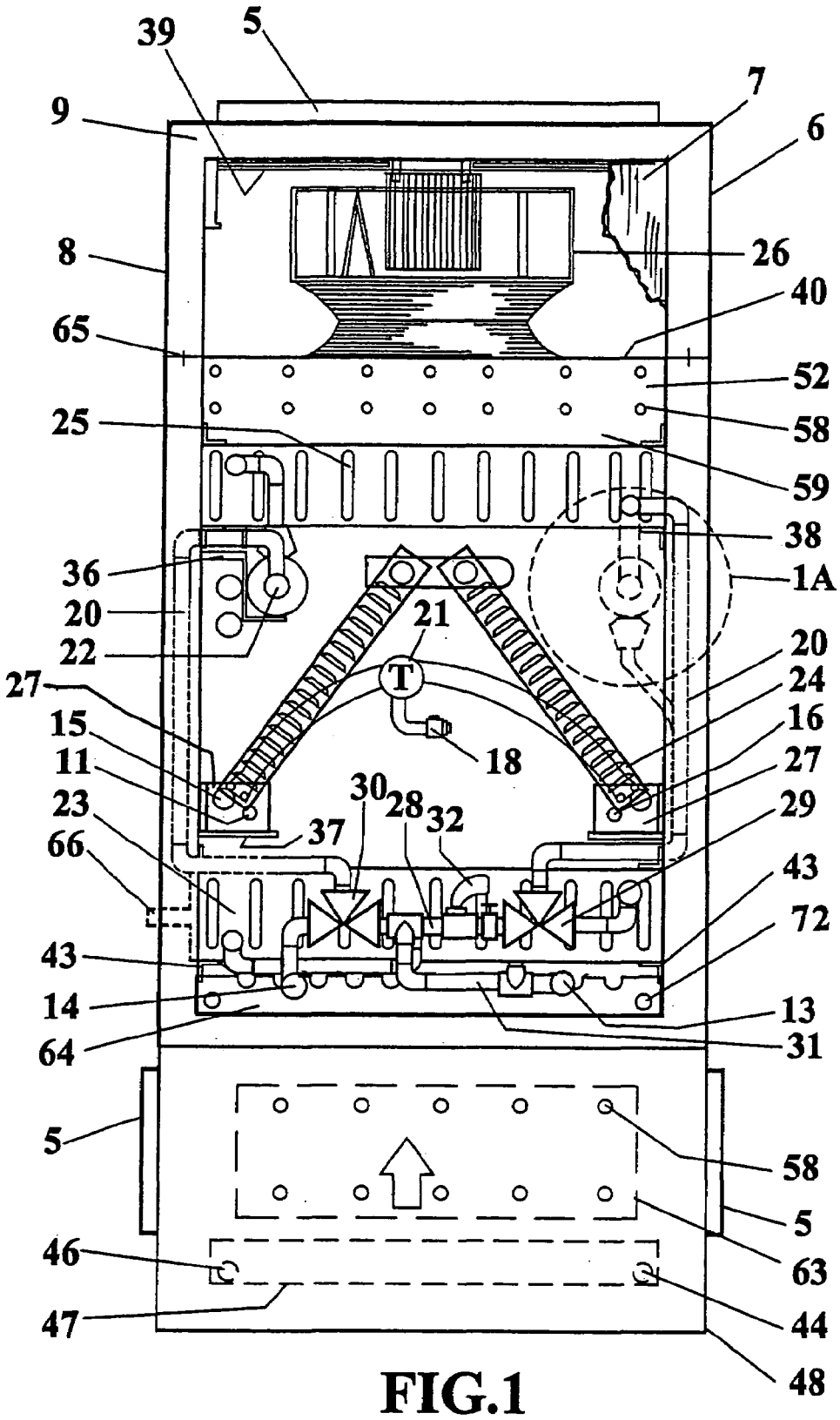
FIG. 1 illustrates a functional diagram according to an embodiment of the invention.
Figure 2:
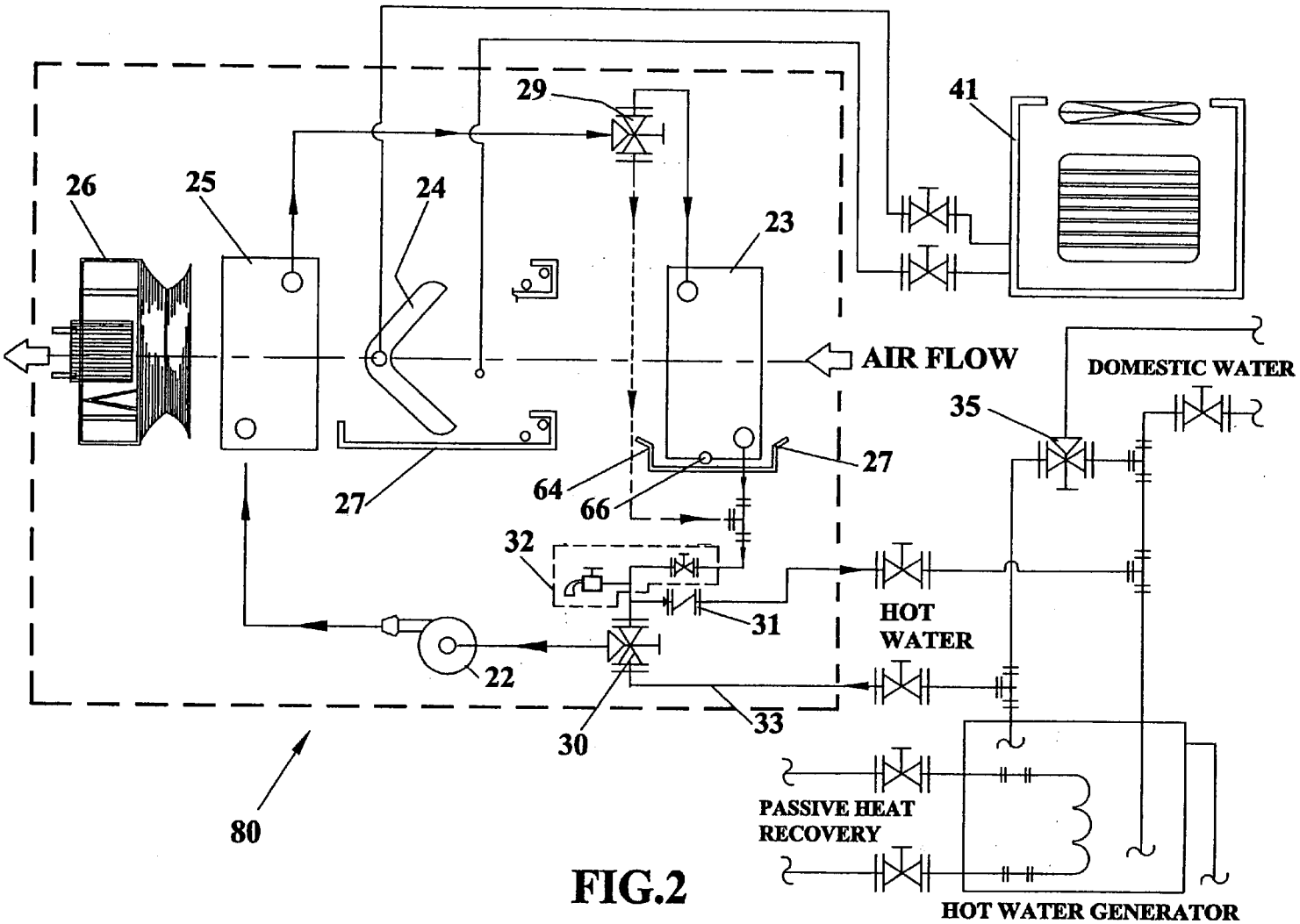
FIG. 2 illustrates a front elevation view of the equipment according to an embodiment of the invention.

Referring to FIGS. 1 and 2, an air conditioning system for cooling, heating, humidifying and dehumidifying circulation air has an insulated cabinet 6 with removable service panels 7 and air supply and return duct flanges 5 with air flow from the bottom of insulated cabinet 6 to the top. In the illustrated embodiment there is a variable speed backward curve single inlet fan 26 supported by fan bracket 39 and a volute fan divisional support panel 40. There is a reheat coil 25 upstream or below the fan 26 supported by a divisional support panel 38 and a control panel 52 intermediate the fan 26 and reheat coil 25.

Upstream of the reheat coil 25 there is a cooling coil 24 having suction outlet conduit 17, thermal expansion valve 21, liquid inlet conduit 18 and a multiposition condensate pan 27. There is also a horizontal condensate outlet 11, vertical condensate outlet 15 and auxiliary outlet 16 for condensate removal. The cooling coil 24 and other elements are supported by coil divisional support panel 37.

Upstream of the cooling coil 24 there is a precool coil 23. In addition associated piping or conduit with valves is located adjacent the precooling coil 23. This includes the precool coil bypass valve 29, hot water control valve 30, multiposition check valve/buffer 31 and purge valve/volume control 32. The three position hot water control valve 30 may be replaced with a two position control valve and a check valve combination (not shown). There is a precool coil divisional support panel 43 for support of the elements of this stage. Also located in this portion of the cabinet 6 are the bypass conduit 28, hot water inlet 14 and hot water outlet 13.

Between the precool coil 23 stage and the reheat coil 25 stage are water flow loop conduits 20 and a circulating pump 22 held by pump bracket 36.

Figure 4A:
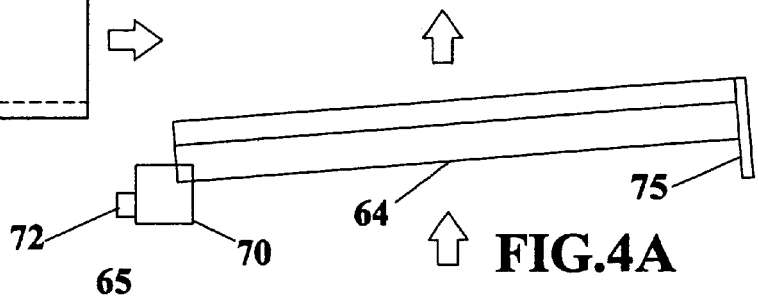
FIG. 4A illustrates a side elevation view of a condensate baffle pan.
Figure 4B:
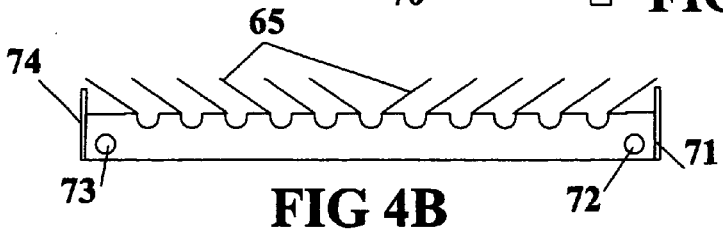
FIG. 4B illustrates a front elevation view of a condensate baffle pan.

Below the precool coil 23 there may be a condensate baffle pan 64 having multiple baffles 65 with associated condensate pan located above vertical air return plenum 48. The condensate baffle panel 64 may be mounted such that there is an approximate 3 to 5 degree positive slope from the rear of the cabinet 6 to the front thereof to facilitate condensate draining into collection pan 70 which has a right side condensate fitting 72 and a left side condensate fitting 73 as illustrated in FIG. 4. There is a right enclosing panel 71, left enclosing panel 74 and rear enclosing bracket 75. The condensate baffle pan 64 may be removably mounted in the cabinet 6. This configuration allows vertical installation of the system 1 without the need for a vertical plenum kit as for example in a closet.

A vertical air return plenum 48 may be used for building basement, garage, utility room and like freestanding installations. Plenum 48 contains a plenum condensate pan 47 with right and left condensate fittings 44, 46. There may be a plenum service panel 63 attached by screws 58. For this configuration right and left return duct flanges 5 and service panels 63 may be used and fitted with air filter grills.

For cooling operation in a high sensible heat ratio environment, the air conditioning system senses the environmental space of a structure by means of a sensor or thermostat 53. When the temperature is ½ to 2 degrees above the thermostat 53 set point for operation, the compressor 41 is activated after a 2 to 75 second delay. The fan 26 then is activated to turn on at a low speed for increase in a time interval to full operating speed. When the thermostat 53 senses a temperature ½ to 2 degrees below the set point, the compressor 41 is deactivated and the fan 26 speed decreases over a time period to turn off.

Under conditions of a low sensible heat ratio the air conditioning system may operate in a cooling and/or dehumidification mode. The sensor 53 activates the compressor 41 and positions the precool coil bypass valve 29 to route water through the precool coil 23. Approximately ½ to 45 seconds thereafter the recirculating pump 22 is activated. Approximately ½ to 45 seconds thereafter the fan 26 is activated to run at the dehumidification operating speed. If the sensor 53 senses the temperature is ½ to 2 degrees below the set point, the precool coil bypass valve 29 is positioned to route water to the bypass conduit 28 and thereby bypassing the precool coil 23, and then the hot water control valve will open. The hot water control valve 30 will then open to the hot water source 33. The airflow will then be heated by reheat coil 25 until a temperature approximately ½ to 2 degrees above the set point is sensed. When such temperature is sensed the hot water control valve 30 will be positioned to shut off the hot water source 33 and then precool coil bypass valve 29 will be positioned to route water through precool coil 23. This cycling will repeat in order to maintain the sensed environment air in the set temperature and humidity range. When the temperature and/or humidity are in the set range the compressor 41, loop recirculating pump 22 and fan 26 will turn off in a reverse sequence from the turn on.

The air conditioning system may also be used for heating only. In a similar manner to the previously described operations, the temperature of the environment is sensed by sensor 53. Within the temperature range set for the system the precool coil bypass valve 29 is positioned to route water through precool coil 23 for heating airflow or to bypass the precool coil 23. The hot water control valve 30 is positioned to introduce hot water 33 into the system, the recirculating pump 22 is activated and the fan 26 activated to operate at selected speeds. A reverse process is used to shut down the air conditioning system upon temperature stabilization. In this mode the compressor 41 is not activated.

The air conditioning system may also be used in a mode for freeze protection and as a heat pump in a defrost mode by proper positioning of the valves to circulate hot water through the system and the precool coil 23 and reheat coil 25. In this mode the cooling coil 24 serves as a condenser. In the defrost mode of operation the cooling coil 24 again serves as an evaporator. In all of these modes of operation the check valve/buffer serves to control the water pressure flow in the system as well as the flow path to recirculate cooled water through the hot water source 33.

The check valve/buffer 31 used in the air conditioning system 1 serves to stabilize system pressure of the water flow loop conduits 20 and associated valves of the water loop system 80 to control the formation of bubbles in the water. The water loop system 80 pressure can vary due to the expansions and contractions of the water when the system exits operations of reheating, pumping, and heat cycles as well as uneven pressure may occur in combination heat, cool, dehumidification when high water use devices such as showers, hot tubs, washers and the like are operated. The high water use without proper regulator control can cause pressure fluctuations in the water loop system 80 that may cause air bubbles to form and reduce or stop the recuperative heat process of the air conditioner system 1.

Figure 12:
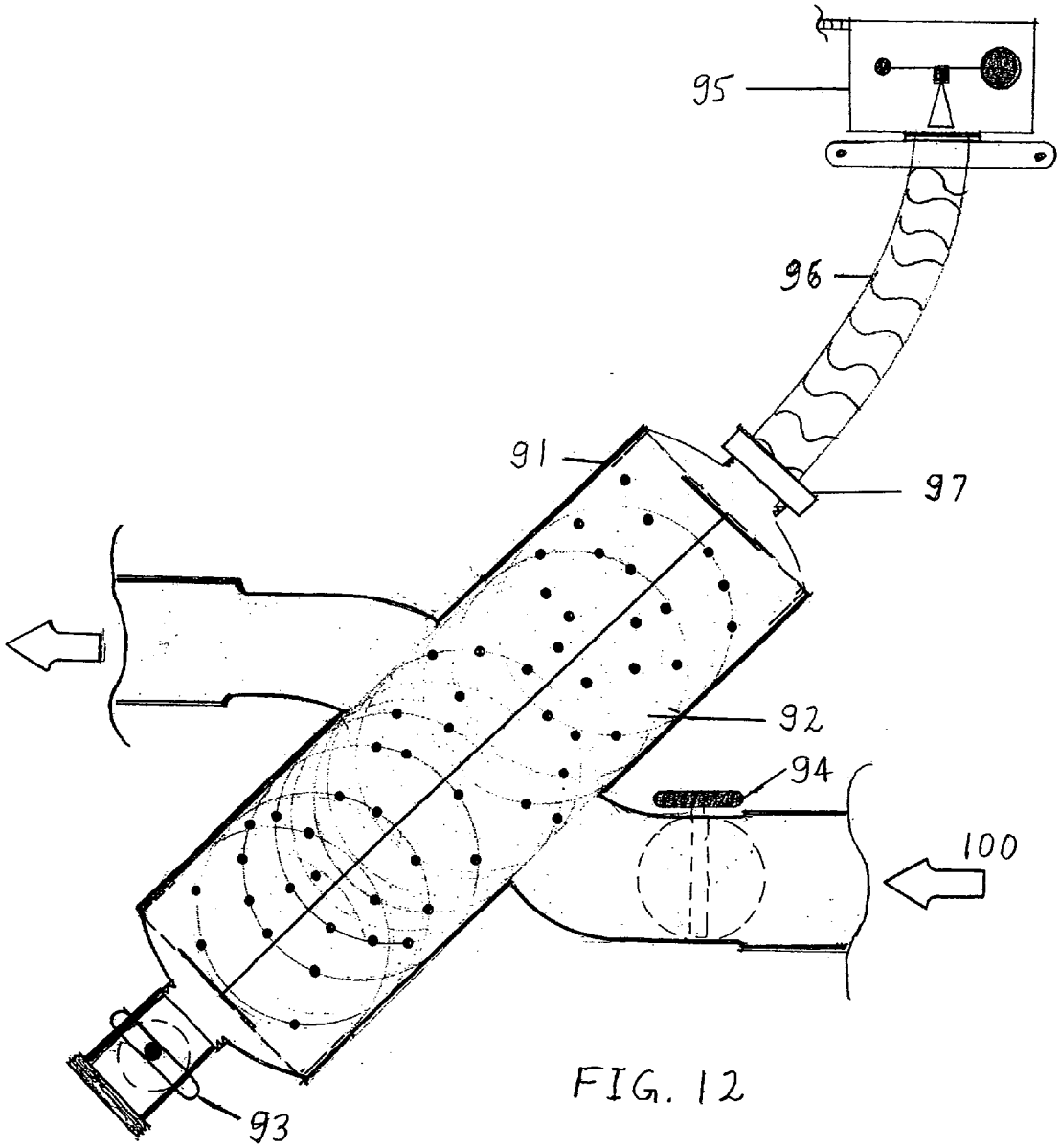
FIG. 12 illustrates a side view of a purge, balance and scrubber combination valve.

Referring to FIGS. 1, 2 and 12, a purge, balance and scrubber combination valve 90 may be located in place of the purge valve 32. The separator body 91 with coalescing fill material 92 may be positioned at a 45 degree angle relative to the fluid flow 100 as illustrated in FIG. 12 which position may allow the air conditioning system 1 to be used in common positions, such as, vertical, horizontal or down flow. The combination valve 90 may have an alternate purge valve 93, a balancing valve 94 and a float valve 95. The float valve 95 may be in fluid communication with the separator body 91 with a flexible hose 96. The flexible hose 96 and float valve 95 may be repositioned without the need for disconnecting or resoldering of the combination valve 90 to accommodate use of the air conditioner in various position orientations. The float valve 95 may facilitate the separation of air from the fluid in the system.

Figure 5:
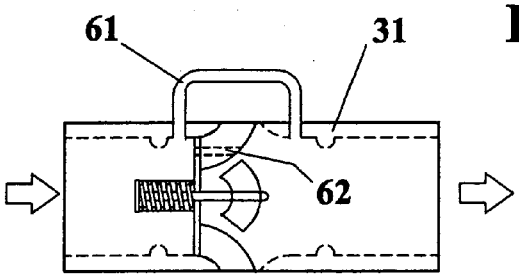
FIG. 5 illustrates a side view of a check valve.

Referring to FIG. 5, the check valve 31 comprises a valve of nonferrous material with no neoprene, rubber or like material as an element thereof. The check valve 31 has a calibrated internal bleed port 62 or a calibrated external bleed tube 61. The internal bleed port or external bleed tube is sized based on the percentage of total fluid flow in the recuperative water loop system 80 when the system 1 is in the recuperative loop system mode.

Figure 5A:
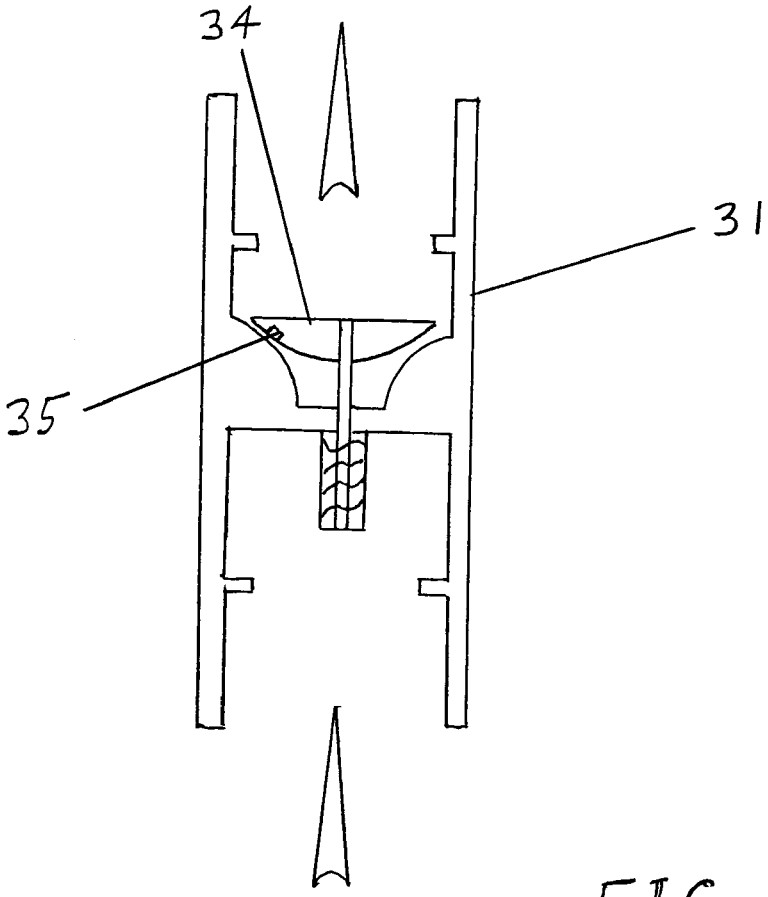
FIG. 5A illustrates a side of a check valve with a calibrated groove.
Figure 5B:
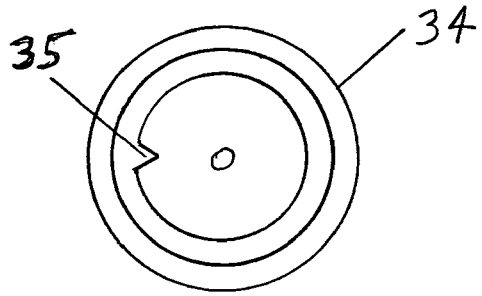
FIG. 5B illustrates a plan view of a valve disk with a calibrated groove.

Referring to FIGS. 5A and 5B, the check valve 31 may have a calibrated groove 35 formed in the edge of a valve disk 34 rather than a bleed tube or internal bleed port. The calibrated groove 35 may provide improved reliability for self cleaning of the check valve 31.

Figure 3:
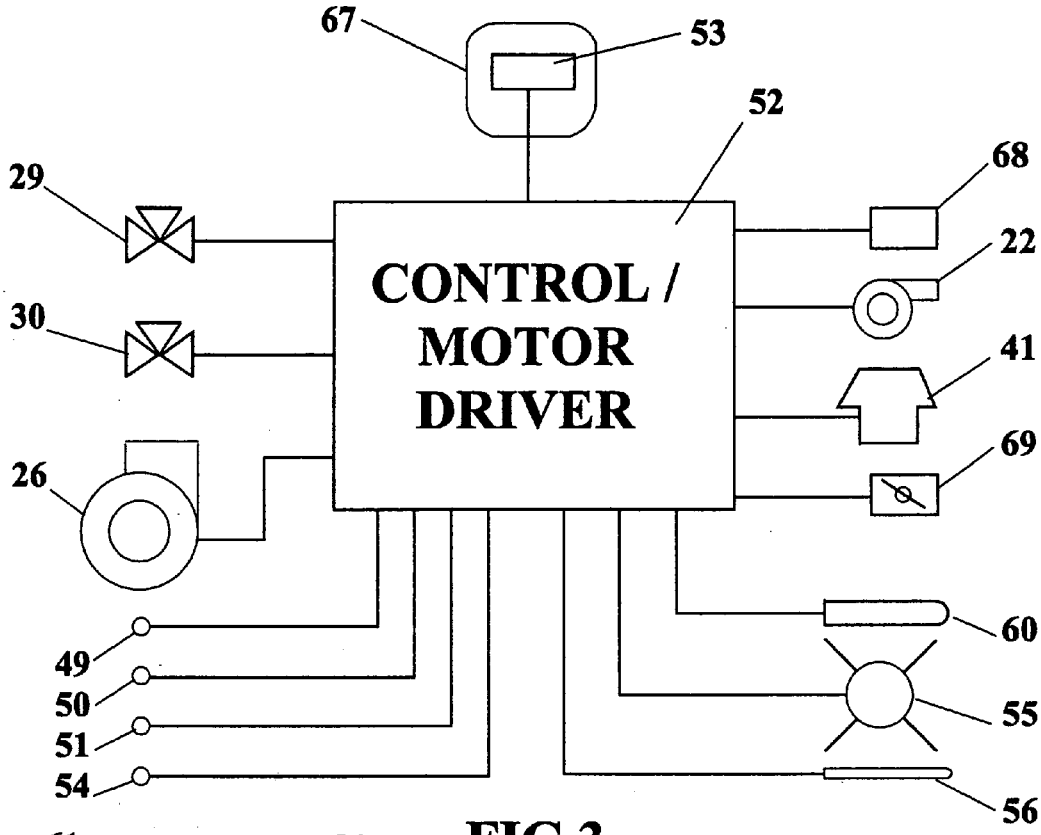
FIG. 3 illustrates a functional block diagram of the control function according to an embodiment of the invention.

Referring to FIGS. 1 through 3, the operation of the air conditioning system 1 control panel 52 comprises control functions as previously described for system 1 operation such as sensor 53 and fan 26 speed control for efficient operation. Additionally to support operations to control formation of bubbles in the water loop system 80 a purge cycle may be incorporated to remove bubbles created by normal outgassing of hydrogen and oxygen from fresh water used in the system. The purge cycle circulates the water with the fan 26 off and bypass valve 29 positioned to route water through precooling coil 23. The system is operated in this state for between approximately ten and sixty two seconds several times in a 24 hour period. The purge valve 32 may be used to adjust the system 1 to the local climate environment and the piping design.

A hot water use priority control system may also be incorporated in the system 1. A hot water supply sensor 51 senses water supply temperature at the inlet to reheat coil 25. The sensor is set to turn the fan 26 on or off in the heating mode depending on a low or high water temperature sensed by the hot water supply sensor 51.

The fan 26 control system incorporates two sensors: reheat coil sensor 49 after reheat coil 25 and cooling coil sensor 50 after cooling coil 24. The sensors communicate with a motor control function incorporated in control panel 52. The fan speed is controlled based on settings to support operating modes as previously described. The fan 26 speed control allows removal of approximately 20% additional air moisture resulting from having a wet cooling coil 24 early in the cooling and dehumidification cycle mode of operation which produces a the higher effective heat transfer area and a lower coil bypass factor.

Referring to FIGS. 3 and 6 through 11, while the invention has been described with reference to a particular air conditioning system, other configurations are possible using the same improved water loop system 80 and associated elements. The control system illustrated in FIG. 3 may have a CO2 or air quality function 68, a fire alarm interface 55, a freeze sensor 54, a fresh air damper/ventilator output 69, a humidifier 60 and an electronic air cleaner 56 to perform tasks to maintain the efficiency of the air handler in the cooling, dehumidification, heating, humidification and air quality control.

Figure 6:
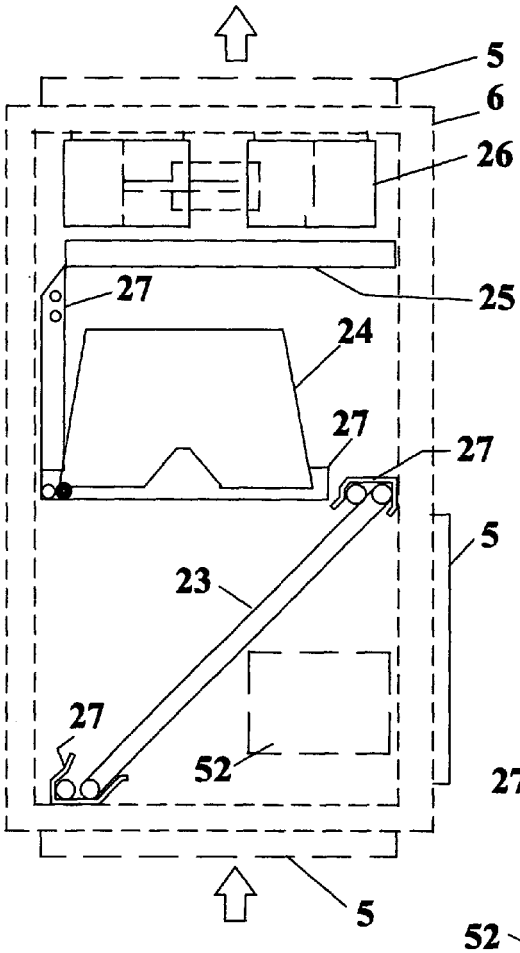
FIG. 6 illustrates a front elevation view of an alternate equipment embodiment.

Other possible physical air conditioning system 1 configurations may include FIG. 6 wherein a double wheel forward curve centrifugal fan 26 is used. The precooling coil 23 is positioned at a 45 degree angle relative to the upper and lower condensate pans 27. The system has bottom and right side return air ducts 5.

Figure 7:
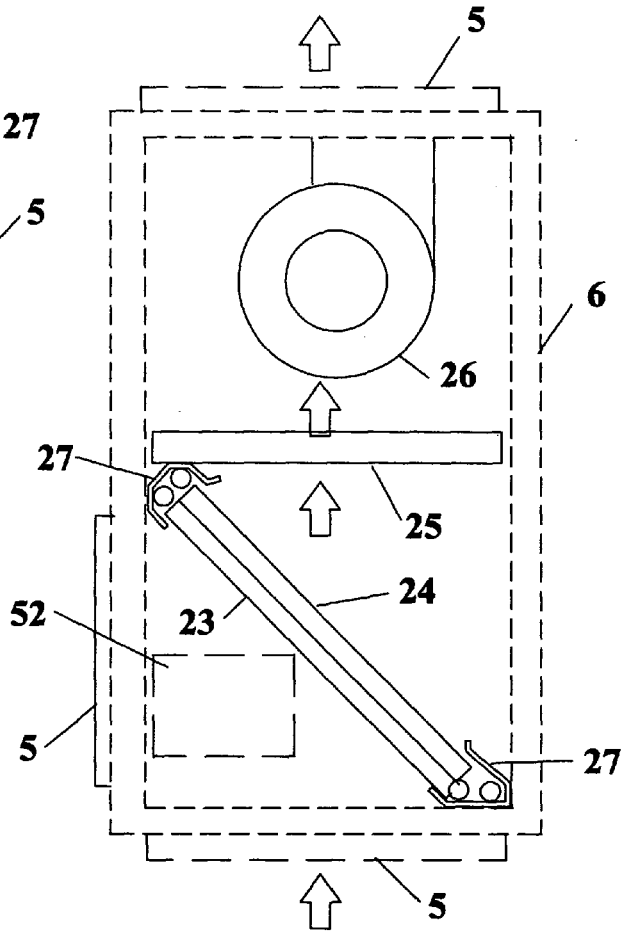
FIG. 7 illustrates a front elevation view of an alternate equipment embodiment.

FIG. 7 illustrates a system 1 with a single blade forward curve centrifugal fan 26 having a combined slab cooling coil 24.

Figure 8:
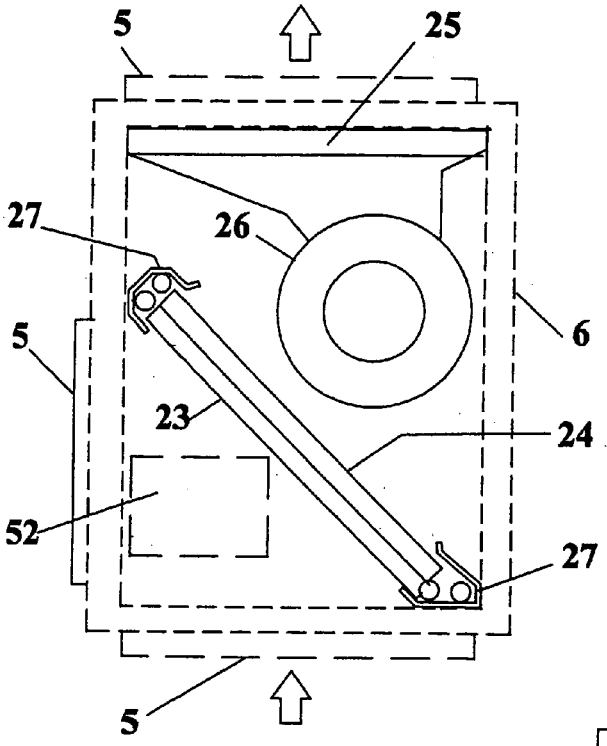
FIG. 8 illustrates a front elevation view of an alternate equipment embodiment.

FIG. 8 illustrates a system 1 with a single wheel forward curve centrifugal fan 26 blowing through reheat coil 25 and pulling through a combination of a slab cooling coil 24 and precooling coil 23 positioned vertically to upper and lower condensate pans 27.

Figure 9:
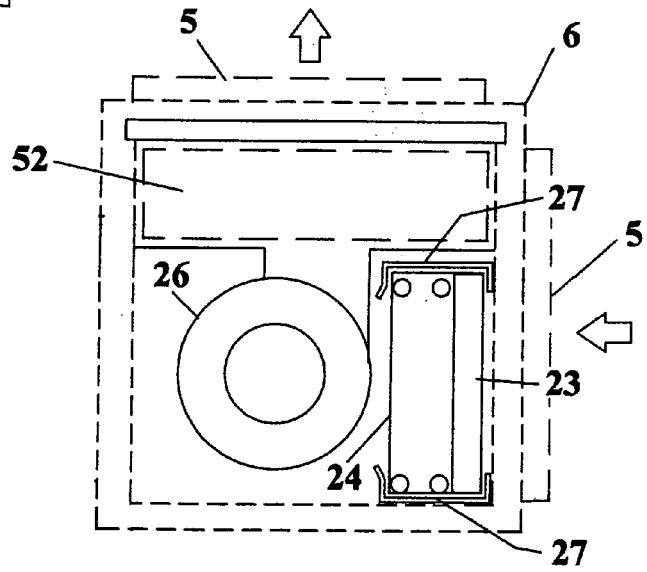
FIG. 9 illustrates a front elevation view of an alternate equipment embodiment.

FIG. 9 illustrates a system 1 with a single wheel forward curve centrifugal fan 26 with cooling coil 24 and precooling coil 23 positioned at a 45 degree angle with condensate pans 27.

Figure 10:
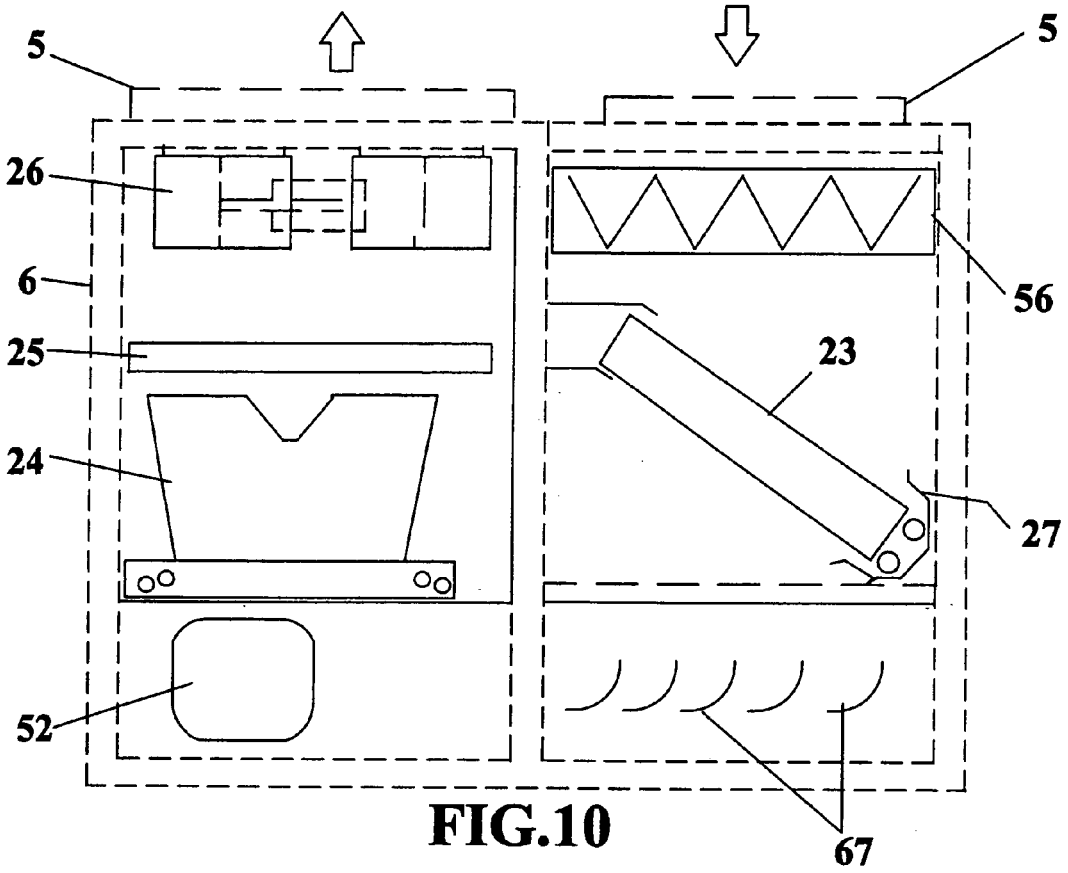
FIG. 10 illustrates a front elevation view of an alternate equipment embodiment.

FIG. 10 illustrates a system 1 in a side by side configuration having a "W" shaped pleated cooling coil 24. This system may be used to replace oil and gas fired furnaces located in a basement and is limited to use in an air up flow application. The system 1 is illustrated with an air cleaner 56 which may be mechanical, electrical and the like. The illustrated system 1 may also contain a humidifier.

Figure 11:
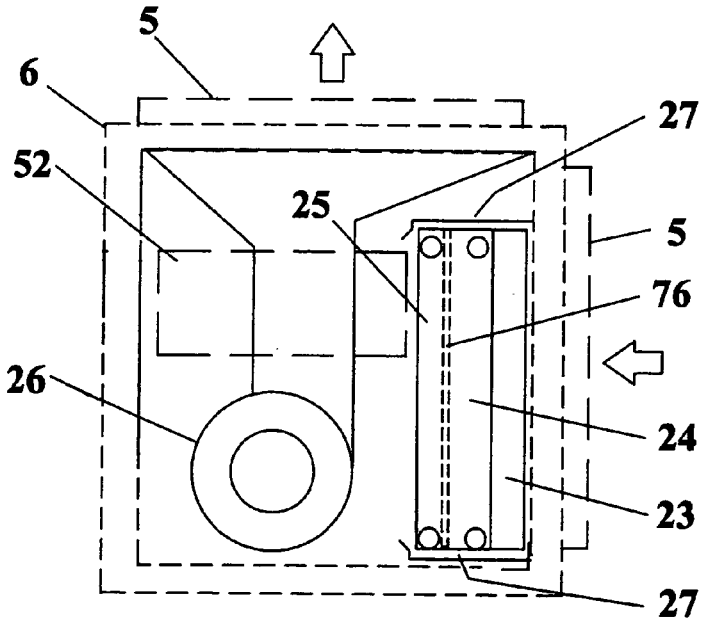
FIG. 11 illustrates a front elevation view of an alternate equipment embodiment.

FIG. 11 illustrates a system 1 in which coils 23, 24 and 25 have a unitized tube sheet with a fin gap 76 between the reheat coil 25 and the cooling coils 24. The construction of the precooling coil 23, cooling coil 24 and reheat coil 25 may utilize one tube sheet as illustrated. However, with such construction a fin gap of ¼ to ½ inch between coil elements may be necessary for a more efficient loop transfer system because of condensate wash that may counteract the heat transfer efficiency of the precooling coil 23 and the reheat coil 25. This condensate wash has been shown to cause problems in existing systems. The precooling coil 23 and reheat coil 25 do not have to be of the same size, shape or capacity. They also do not have to be of the same fin design, coil pattern or other like element parameters.

Again, referring to FIG. 1, by removing the horizontal condensate pan 27 and inverting the cooling coil 24 and coil divisional support panel 37, the air conditioning system 1 may be used in an air flow down application. When used in such a configuration proper consideration to collecting all condensate must be taken.

There has been disclosed a system that employs a water loop system that includes a check valve and operating modes to minimize problems in system compatibility with various environments and the use of domestic water supply sources. The system may be installed with or without a domestic humidistat, may use single, multiple, variable capacity and/or dual compressor condensing units and may be connected to a domestic or dedicated hot water supply system. The system is compatible with air-to-air, dual fuel heat pumps, ground or water well heat pumps, chillers, ice banks, liquid storage systems, slurry storage systems and other systems. The elements can be produced including direct expansion or chilled water cooling. The structure is compatible with a wide variety of equipment configurations for use in various building installation configurations.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A fluid flow system for use in heating, cooling and dehumidifying an air flow stream in an air conditioning system comprising:

a reheat coil downstream of a precool coil and having a cooling coil positioned therebetween in the air flow stream;

a hot water control valve in fluid communication with the precool coil, a hot fluid source and the reheat coil;

a bypass valve in fluid communication with the reheat coil, the precool coil and a bypass conduit;

a pump intermediate the hot water control valve and the reheat coil to pump a fluid in a fluid flow through the fluid flow system; and a check valve in fluid communication with the fluid flow system intermediate the precool coil and the hot water control valve.

2. The fluid flow system as in claim 1 wherein the fluid flow comprising:

the pump pumping the fluid from the hot water control valve through the reheat coil to the bypass valve;

the fluid circulating through the precool coil when the bypass valve is in a first position and the fluid passing through the bypass conduit when the bypass valve is in a second position; and the fluid returning to the hot water control valve for recirculation therethrough; and the check valve stabilizing fluid pressure in the fluid flow system.

3. The fluid flow system as in claim 2 wherein the hot water control valve is positioned for passing therethrough of a hot fluid received from the hot fluid source to be circulated by the pump; and the hot fluid may exit the fluid flow system through the check valve.

4. The fluid flow system as in claim 1 wherein there is a purge valve in fluid communication with the fluid flow system intermediate the precool coil and the check valve.

5. The fluid flow system as in claim 1 wherein the hot fluid source is a hot water source.

6. The fluid flow system as in claim 1 wherein the check valve is structured to control the formation of gas bubbles in the fluid.

7. The fluid flow system as in claim 1 wherein the check valve is constructed of a nonferrous material and has an internal bleed port integral therein.

8. The fluid flow system as in claim 1 wherein the check valve is constructed of a nonferrous material and has an external bleed tube.

9. The fluid flow system as in claim 7 wherein the internal bleed port is sized as determined by a percentage of a total fluid flow in the fluid flow system when in a recuperative system mode.

10. The fluid flow system as in claim 1 wherein a control panel having the functions of controlling the fluid flow system for cooling, humidification, dehumidification, heating, freeze protecting, and defrost comprising:

determining the position of the bypass valve and the hot water control valve; and setting the sequence of turn on and turn off of the pump and fan as well as a compressor in fluid communication with the cooling coil.

11. A fluid flow system as in claim 1 wherein the pump is positioned intermediate the reheat coil and the bypass valve.

12. The flow system as in claim 1 wherein there is a condensate baffle pan mounted under the precool coil.

13. The fluid flow system as in claim 1 wherein the reheat coil and the cooling coil are formed of a unitized tube sheet having a fin gap therebetween.

14. The fluid flow system as in claim 13 wherein the fin gap is greater than ¼ to ½ inches.

15. The fluid flow system as in claim 13 wherein the precool coil is formed as part of the unitized tube sheet.

16. A fluid flow system for use in heating, cooling and dehumidifying an air flow stream in an air conditioning system comprising:

a reheat coil downstream of a precool coil and having a cooling coil positioned therebetween in the air flow stream;

a hot water control valve in fluid communication with the precool coil, a hot fluid source and the reheat coil;

a bypass valve in fluid communication with the reheat coil, the precool coil and a bypass conduit;

a check valve in fluid communication with the fluid flow system intermediate the precool coil and the hot water control valve;

a pump intermediate the hot water control valve and the reheat coil to pump a fluid in a fluid flow through the fluid flow system;

wherein the fluid flow comprising:

the pump pumping the fluid from the hot water control valve through the reheat coil to the bypass valve;

the fluid circulating through the precool coil when the bypass valve is in a first position and the fluid passing through the bypass conduit when the bypass valve is in a second position; and the fluid returning to the hot water control valve for recirculation therethrough; and the check valve stabilizing fluid pressure in the fluid flow system.

17. The fluid flow system as in claim 16 wherein the hot water control valve is positioned for passing therethrough of a hot fluid received from the hot fluid source to be circulated by the pump; and the hot fluid may exit the fluid flow system through the check valve.

18. The fluid flow system as in claim 16 wherein there is a purge valve in fluid communication with the fluid flow system intermediate the precool coil and the check valve.

19. The fluid flow system as in claim 16 wherein the check valve is structured to control the formation of gas bubbles in the fluid.

20. The fluid flow system as in claim 16 wherein an internal bleed port is sized as determined by a percentage of a total fluid flow in the fluid flow system when in a recuperative system mode.

21. The fluid flow system as in claim 16 wherein a control panel having the functions of controlling the fluid flow system for cooling, humidification, dehumidification, heating, freeze protecting, and defrost comprising:

determining the position of the bypass valve and the hot water control valve; and setting the sequence of turn on and turn off of the recirculating pump and fan as well as a compressor in fluid communication with the cooling coil.

22. A fluid flow system for use in heating, cooling and dehumidifying an air flow stream in an air conditioning system comprising:

a reheat coil downstream of a precool coil and having a cooling coil positioned therebetween in the air flow stream;

a hot water control valve in fluid communication with the precool coil, a hot fluid source and the reheat coil;

a bypass valve in fluid communication with the reheat coil, the precool coil and a bypass conduit;

a check valve in fluid communication with the fluid flow system intermediate the precool coil and the hot water control valve and the check valve is structured to control the formation of gas bubbles in the fluid;

the hot water control valve is positioned for passing therethrough of a hot fluid received from the hot fluid source to be circulated by a pump and the hot fluid may exit the fluid flow system through the check valve;

a purge valve in fluid communication with the fluid flow system intermediate the precool coil and the check valve;

an internal bleed port in the check valve is sized as determined by a percentage of a total fluid flow in the fluid flow system when in a recuperative system mode;

the pump intermediate the hot water control valve and the reheat coil to pump a fluid in a fluid flow through the fluid flow system;

wherein the fluid flow comprising:

the pump pumping the fluid from the hot water control valve through the reheat coil to the bypass valve;

the fluid circulating through the precool coil when the bypass valve is in a first position and the fluid passing through the bypass conduit when the bypass valve is in a second position;

the fluid returning to the hot water control valve for recirculation therethrough;

the check valve stabilizing fluid pressure in the fluid flow system;

a control panel having the functions of controlling the fluid flow system for cooling, humidification, dehumidification, heating, freeze protecting, and defrost comprising:

determining the position of the bypass valve and the hot water control valve; and setting the sequence of turn on and turn off of the recirculating pump and fan as well as a compressor in fluid communication with the cooling coil.

23. The fluid flow system as in claim 1 wherein the check valve has a valve disk having a calibrated groove formed therein.

24. The fluid flow system as in claim 1 wherein there is a combination valve in fluid communication with the fluid flow system intermediate the precool coil and the check valve.

25. The fluid flow system as in claim 24 wherein the combination valve comprising; a separator body having a coalescing fill material therein; and alternate purge valve; a balancing valve; and a float valve in fluid communication with the separator body.

26. The fluid flow system as in claim 25 wherein the separator body is positioned at a 45 degree angle relative to a fluid flow.

* * * * *